US011610725B2

(12) United States Patent
Kim et al.

(10) Patent No.: US 11,610,725 B2
(45) Date of Patent: Mar. 21, 2023

(54) COIL COMPONENT

(71) Applicant: SAMSUNG ELECTRO-MECHANICS CO., LTD., Suwon-si (KR)

(72) Inventors: Jae Hun Kim, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 792 days.

(21) Appl. No.: 16/527,931

(22) Filed: Jul. 31, 2019

(65) Prior Publication Data

US 2020/0294709 A1 Sep. 17, 2020

(30) Foreign Application Priority Data

Mar. 15, 2019 (KR) ..... 10-2019-0029956

(51) Int. Cl.

| | |
|---|---|
| ***H01F 27/30*** | (2006.01) |
| ***H01F 27/28*** | (2006.01) |
| ***H01F 27/02*** | (2006.01) |
| ***H01F 27/26*** | (2006.01) |

(52) U.S. Cl.

CPC ..... *H01F 27/2823* (2013.01); *H01F 27/02* (2013.01); *H01F 27/266* (2013.01)

(58) Field of Classification Search

CPC ..... H01F 27/2823
USPC ..... 336/199
See application file for complete search history.

(56) References Cited

U.S. PATENT DOCUMENTS

| | | | | |
|---|---|---|---|---|
| 7,209,022 | B2 * | 4/2007 | Kuroiwa | H01F 17/045 336/200 |
| 8,723,629 | B1 * | 5/2014 | Liu | H01F 27/022 336/212 |
| 2010/0271162 | A1 * | 10/2010 | Yan | H01F 17/04 336/98 |
| 2011/0005064 | A1 * | 1/2011 | Klesyk | H01F 27/027 29/605 |

(Continued)

FOREIGN PATENT DOCUMENTS

| | | |
|---|---|---|
| EP | 0 939 412 A2 | 9/1999 |
| JP | H11-54329 A | 2/1999 |

(Continued)

OTHER PUBLICATIONS

Office Action issued in corresponding Korean Patent Application No. 10-2019-0029956 dated Mar. 11, 2020, with English translation.

*Primary Examiner* — Ronald Hinson
(74) *Attorney, Agent, or Firm* — Morgan, Lewis & Bockius LLP

(57) ABSTRACT

A coil component includes a mold portion having a first surface and the second surface opposing each other, a winding coil disposed in the second surface of the mold portion, a cover portion disposed on the mold portion and the winding coil, and accommodating grooves on the first surface of the mold portion to be spaced apart from each other, and in which both ends of the winding coil are disposed, the accommodating grooves extend from one side of the mold portion in a width direction, and a minimum distance from the accommodating grooves to the second surface of the mold portion increases or decreased in the width direction.

18 Claims, 9 Drawing Sheets

(56) References Cited

U.S. PATENT DOCUMENTS

| | | | | |
|---|---|---|---|---|
| 2012/0188040 | A1 | 7/2012 | Ogawa et al. | |
| 2012/0274433 | A1* | 11/2012 | Matsumoto ..... | H01F 27/292<br>336/192 |
| 2013/0186995 | A1 | 7/2013 | Yamaguchi et al. | |
| 2016/0086725 | A1 | 3/2016 | Igarashi | |

FOREIGN PATENT DOCUMENTS

| | | | |
|---|---|---|---|
| JP | 3213895 | U | 12/2017 |
| KR | 10-1999-0073013 | A | 9/1999 |
| KR | 10-2012-0085176 | A | 7/2012 |
| KR | 10-2013-0018507 | A | 2/2013 |
| WO | 2015/005129 | A1 | 1/2015 |

* cited by examiner

COIL COMPONENT

CROSS-REFERENCE TO RELATED APPLICATION(S)

This application claims the benefit of priority to Korean Patent Application No. 10-2019-0029956 filed on Mar. 15, 2019 in the Korean Intellectual Property Office, the entire disclosure of which is incorporated herein by reference.

TECHNICAL FIELD

The present disclosure relates to a coil component.

BACKGROUND

In order to manufacture a coil component, a magnetic mold and a winding type coil may be used.

To install the coil component in a limited space, miniaturization and thinning (low-profile) are required.

In order to improve electrical characteristics of a coil component (such as allowable current and DC resistance), it is necessary to secure a wide winding area. However, a winding type coil component according to the related art has a problem in which it is difficult to secure a magnetic flux area in the entirety of the coil component by the volume occupied by the external electrode.

SUMMARY

An aspect of the present disclosure is to provide a coil component which can be lightweight, thin, short, and small, while maintaining component characteristics by securing a magnetic flux area.

According to an aspect of the present disclosure, a coil component includes a mold portion having one side and the other side opposing each other, a winding coil disposed in the other side of the mold portion, a cover portion disposed on the mold portion and the winding coil, and accommodating grooves formed in one side of the mold portion to be spaced apart from each other, and in which both ends of the winding coil are disposed, the accommodating grooves are formed to be extended from one side of the mold portion in one direction, and a distance from a bottom surface of the accommodating grooves to the other side of the mold portion increases or decreased in the one direction.

Other features and aspects will be apparent from the following detailed description, the drawings, and the claims.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
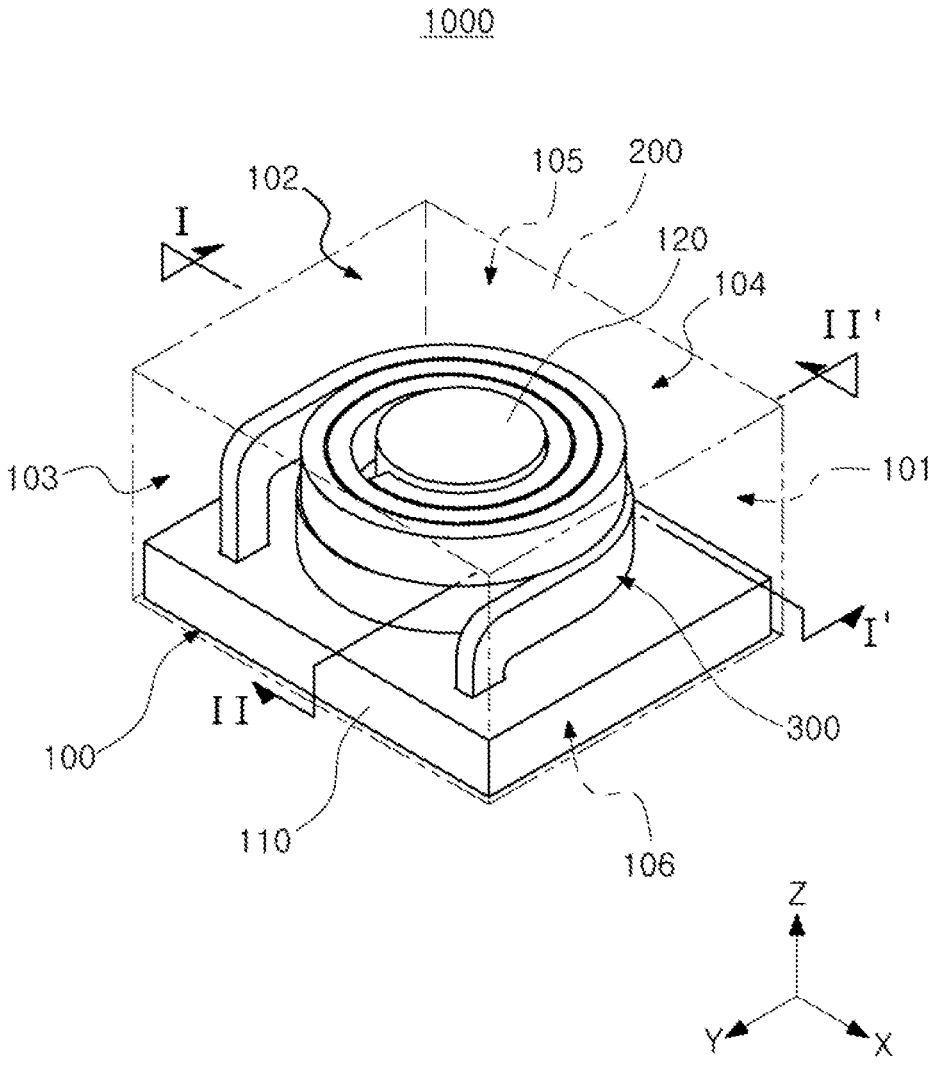
FIG. 1 is a schematic view of a coil component according to a first embodiment.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "or" includes any and all combinations of one or more of the associated listed items.

It will be apparent that though the terms first, second, third, etc. may be used herein to describe various members, components, regions, layers or sections, these members, components, regions, layers or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" other elements would then be oriented "below," or "lower" the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," or "comprising" when used in this specification, specify the presence of stated features, integers, steps, operations, members, elements, or groups thereof, but do not preclude the presence or addition of one or more other features, integers, steps, operations, members, elements, or groups thereof.

Hereinafter, embodiments of the present disclosure will be described with reference to schematic views illustrating embodiments of the present disclosure. In the drawings, for example, due to manufacturing techniques or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

In the drawings, the X direction may be defined as a first direction or a longitudinal direction, the Y direction may be defined as a second direction or a width direction, and the Z direction may be defined as a third direction or a thickness direction.

Hereinafter, a coil component according to an embodiment will be described in detail with reference to the accompanying drawings. Referring to the accompanying drawings, the same or corresponding components are denoted by the same reference numerals, and a duplicate description thereof will be omitted.

Various types of electronic components are used in electronic devices. Here, various types of coil components may be suitably used for the purpose of noise removal or the like among these electronic components.

In other words, a coil component in an electronic device may be used as a power inductor, a high frequency (HF) inductor, a general bead, a GHz bead, a common mode filter, or the like.

First Embodiment

Figure 2:
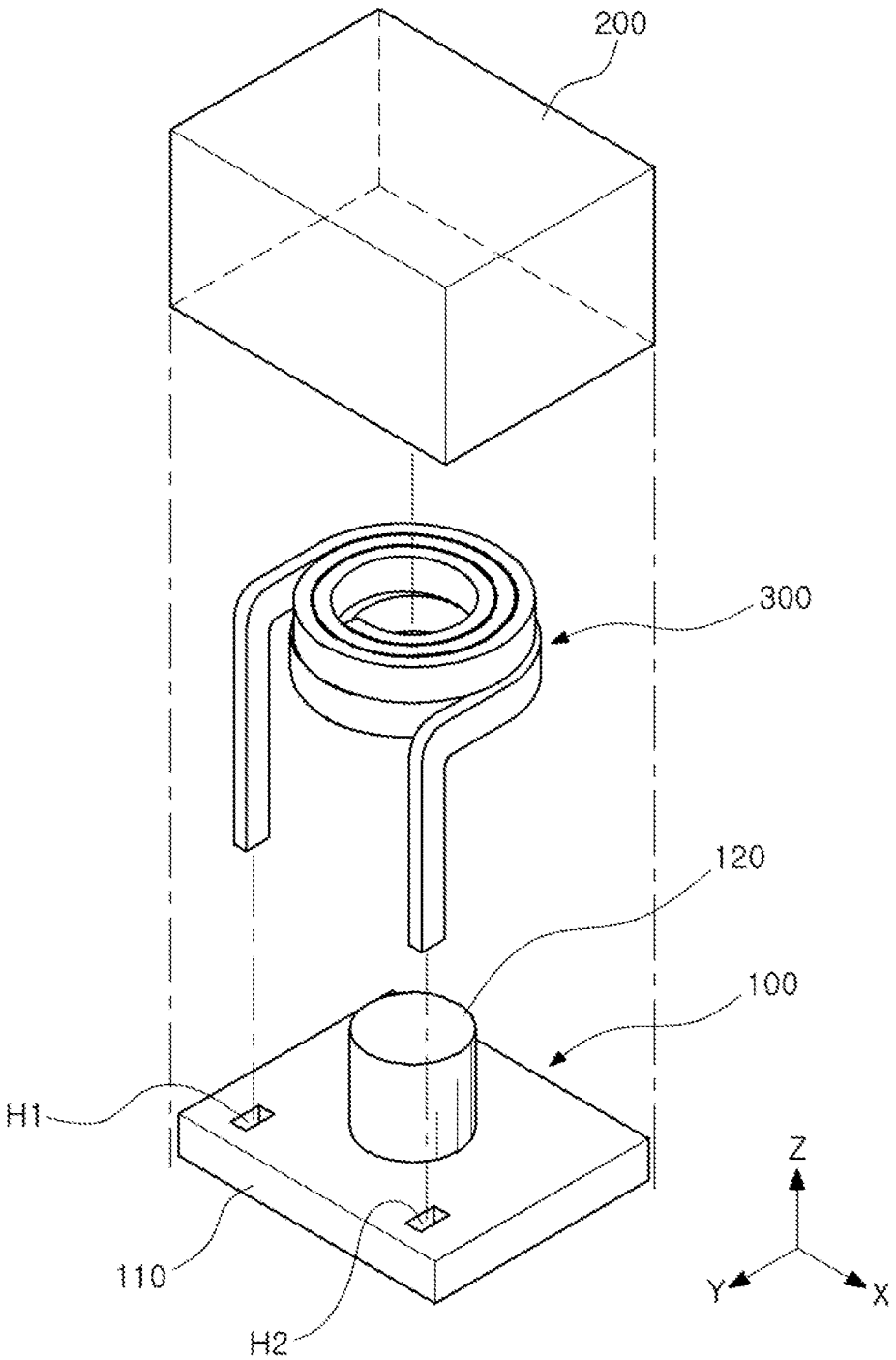
FIG. 2 is an exploded perspective view of FIG. 1.
Figure 3:
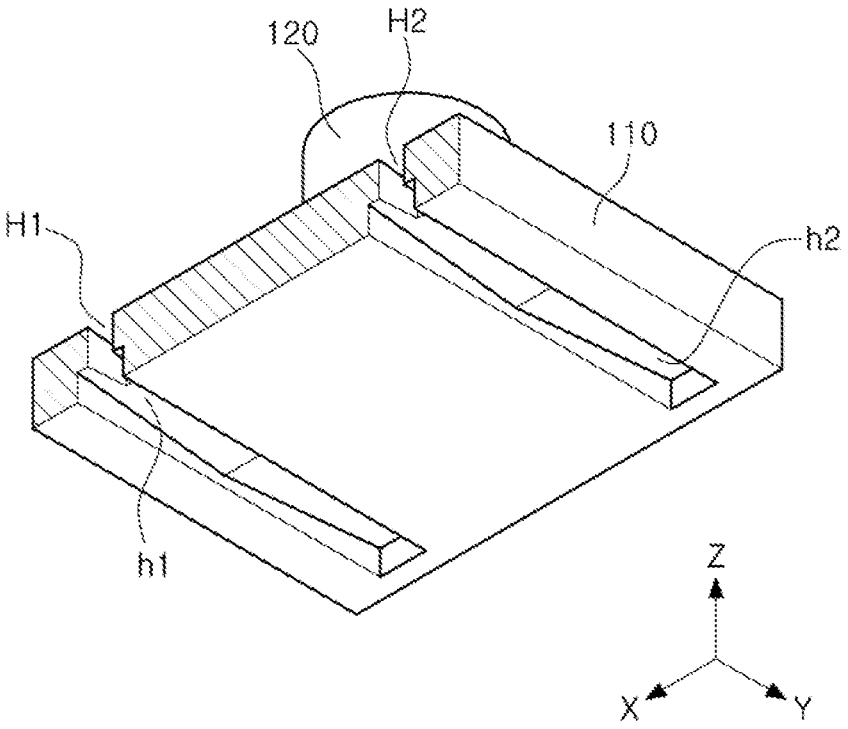
FIG. 3 is a perspective view in which a portion of a mold portion, applied to the coil component according to a first embodiment, is cut on the X-Z plane and seen from a lower direction.
Figure 4:
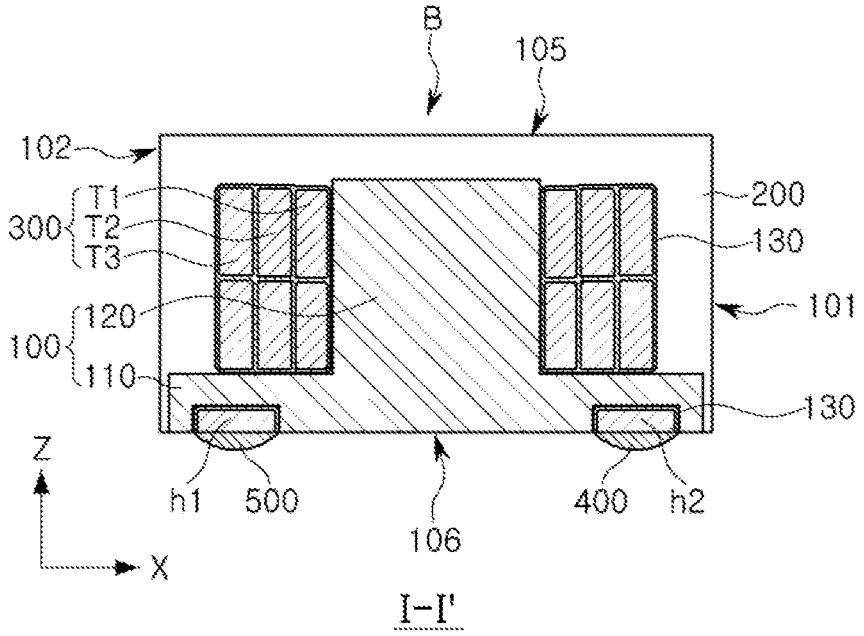
FIG. 4 is a view in which a mold portion, applied to the coil component according to a first embodiment, is taken on line I-I' of FIG. 1.
Figure 5:
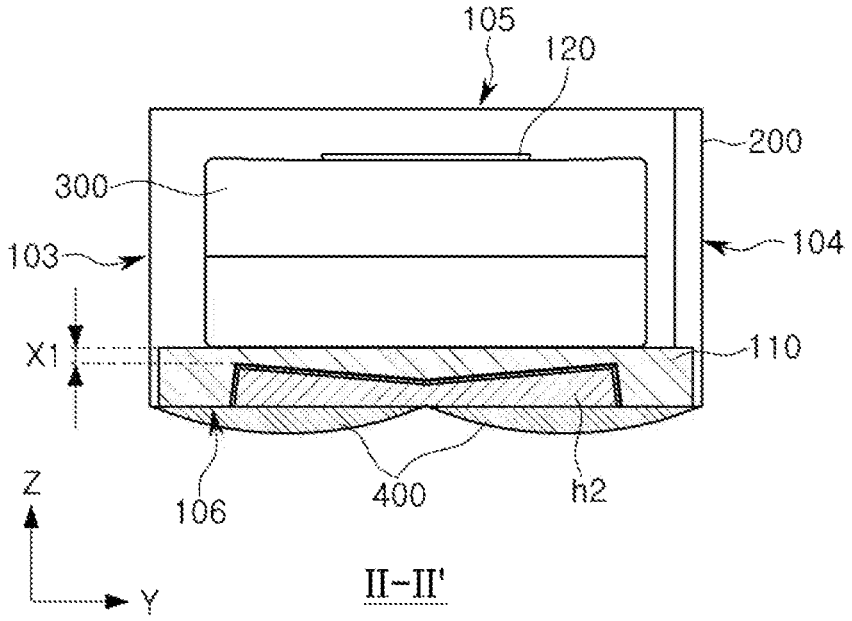
FIG. 5 is a view in which a mold portion, applied to the coil component according to a first embodiment, is taken on line II-II' of FIG. 1.

FIG. 1 is a schematic view of a coil component according to a first embodiment. FIG. 2 is an exploded perspective view of FIG. 1. FIG. 3 is a perspective view in which a portion of a mold portion, applied to the coil component according to a first embodiment, is cut on the X-Z plane and seen from a lower direction. FIG. 4 is a view in which a mold portion, applied to the coil component according to a first embodiment, is taken on line I-I' of FIG. 1. FIG. 5 is a view in which a mold portion, applied to the coil component according to a first embodiment, is taken on line II-II' of FIG. 1.

Referring to FIGS. 1 to 5, a coil component 1000 according to a first embodiment includes a mold portion 100, a winding coil 300, a cover portion 200, and accommodating grooves h1 and h2, and may further include external electrodes 400 and 500.

A body B forms an appearance of the coil component 1000 according to an embodiment, and the winding coil 300 is embedded therein. The body B includes a mold portion 100 and a cover portion 200. The mold portion 100 may include a core 120.

The body B may be hexahedral as a whole.

Based on FIGS. 1 and 2, the body B includes a first surface 101 and a second surface 102 opposing each other in a longitudinal direction X, a third surface 103 and a fourth surface 104 opposing each other in a width direction Y, as well as a fifth surface 105 and a sixth surface 106 opposing each other in a thickness direction Z. Each of the first to fourth surfaces 101, 102, 103, and 104 of the body B may correspond to a wall of the body B, connecting the fifth surface 105 to the sixth surface 106 of the body B. Hereinafter, both ends of the body B refer to the first surface 101 and the second surface 102 of the body B, while both sides of the body B refer to the third surface 103 and the fourth surface 104 of the body B.

The body B may be formed to allow the coil component 1000 according to an embodiment having external electrodes 400 and 500 to be described later to have a length of 2.0 mm, a width of 1.2 mm, and a thickness of 0.65 mm, by way of example, but is not limited thereto.

Here, the body B includes a mold portion 100 and a cover portion 200, and the cover portion 200 is disposed on an upper portion of the mold portion 100 to cover all surfaces except for a lower surface of the mold portion 100, based on FIG. 1. Thus, the first to fifth surfaces 101, 102, 103, 104, and 105 of the body B are formed by the cover portion 200, while the sixth surface 106 of the body B is formed by the mold portion 100 and the cover portion 200.

The mold portion 100 has one side and the other side opposing each other. One side of the mold portion 100 is a surface corresponding to a lower surface of the mold portion 100, and refers to a region in which the accommodating grooves h1 and h2, to be described later, are disposed. As will be described later, the accommodating grooves h1 and h2 are processed in the mold portion 100, and thus bottom surfaces of the accommodating grooves h1 and h2 may be disposed in a region between one side and the other side of the mold portion 100. The mold portion 100 includes a support portion 110 and a core 120. The core 120 has a shape, passing through the winding coil 300, and is disposed in a center portion of the other side of the support portion 110. In this regard, in the specification, one side and the other side of the mold portion 100 are used in the same sense as one side and the other side of the support portion 110, respectively.

The mold portion 100 may be formed by filling a mold for formation of the mold portion 100 with a magnetic material. Alternatively, the mold portion 100 may be formed by filling a mold with a composite material, containing a magnetic material and an insulating resin.

A thickness of the support portion 110 may be 200 μm or more. If the thickness of the support portion 110 is less than 200 μm, it may be difficult to secure rigidity. A thickness of the core 120 may be 150 μm or more, but is not limited thereto.

The winding coil 300 is embedded in the body B, thereby having characteristics of the coil component 1000. For example, when the coil component 1000 according to an embodiment is used as a power inductor, the winding coil 300 may function to stabilize the power of an electronic device by storing an electric field as a magnetic field and maintaining an output voltage.

The winding coil 300 is disposed in the other side of the mold portion 100. In detail, the winding coil 300 is wound around the core 120, and is disposed in the other side of the support portion 110.

The winding coil 300 is an air core coil, and may be provided as a rectangular coil. The winding coil 300 may be formed by winding a metal wire such as a copper wire, of which a surface is coated with an insulating material, in a spiral shape.

The winding coil 300 may be composed of a plurality of layers. Each layer of the winding coil 300 is formed in a flat spiral shape, and may have a plurality of number of turns. In other words, the winding coil 300 forms an innermost turn T1, at least one middle turn T2, and an outermost turn T3, from a center portion of one side of the mold portion 100.

The cover portion 200 may be disposed on the mold portion 100 and the winding coil 300. The cover portion 200 covers the mold portion 100 and the winding coil 300. The cover portion 200 may be disposed on the support portion 110 and the core 120, of the mold portion 100, and the winding coil 300, and is then pressed to be coupled to the mold portion 100.

At least one between the mold portion 100 and the cover portion 200 includes a magnetic material. In an embodiment, both the mold portion 100 and the cover portion 200 include a magnetic material.

The magnetic material may be ferrite or magnetic metal powder.

The ferrite powder may be, for example, at least one or more among spinel type ferrite such as Mg—Zn-based, Mn—Zn-based, Mn—Mg-based, Cu—Zn-based, Mg—Mn—Sr-based, Ni—Zn-based ferrite, or the like, hexagonal ferrite such as Ba—Zn-based, Ba—Mg-based, Ba—Ni-based, Ba—Co-based, Ba—Ni—Co-based ferrite, or the like, garnet type ferrite such as Y-based ferrite, or the like, and Li-based ferrite.

The magnetic metal powder may include one or more selected from the group consisting of iron (Fe), silicon (Si), chromium (Cr), cobalt (Co), molybdenum (Mo), aluminum (Al), niobium (Nb), copper (Cu), and nickel (Ni). For example, the magnetic metal powder may be at least one or more among a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The magnetic metal powder may be amorphous or crystalline. For example, the magnetic metal powder may be a Fe—Si—B—Cr-based amorphous alloy powder, but is not limited thereto.

Each of the ferrite and the magnetic metal powder particle may have an average diameter of about 0.1 μm to 30 μm, but is not limited thereto.

Each of the mold portion 100 and the cover portion 200 may include two or more types of magnetic material. Here, the different types of magnetic materials mean that magnetic materials are distinguished from each other by any one of an average diameter, a composition, crystallinity, and a shape.

The insulating resin may include one among epoxy, polyimide, a liquid crystal polymer, or a mixture thereof, but is not limited thereto.

The first and second accommodating grooves h1 and h2 are formed on one side of the mold portion 100 to be spaced apart from each other, and both ends of the winding coil 300, to be described later, are disposed in the accommodating grooves h1 and h2. For example, referring to FIG. 3, each of the accommodating grooves h1 and h2 is formed in one side of the mold portion 100, and the accommodating grooves are spaced apart from each other in a longitudinal direction X. The accommodating grooves h1 and h2 may be disposed outside a region, corresponding to a core 120, of a one side of the mold portion 100.

Each of the accommodating grooves h1 and h2 may be formed to be extended from one side of the mold portion 100 in one direction. For example, referring to FIG. 3, each of the accommodating grooves h1 and h2 is formed in one side of the mold portion 100 to be extended in a width direction Y. In an embodiment, the body B is a region including a mold portion 100 and a cover portion 200. In this regard, one side of the body B refers to one side of a region including a mold portion 100 and a cover portion 200. One end of the winding coil 300 is disposed in the first accommodating groove h1, the other end thereof is disposed in the second accommodating groove h2, and one end and the other end, of the winding coil, are spaced apart from each other. The first and second accommodating grooves h1 and h2 are regions allowing both ends of the winding coil 300 to lead out toward the external electrodes 400 and 500, and are thus formed in one side of the body B to be spaced apart from each other to correspond to the first and second external electrodes 400 and 500, respectively.

A distance X1 from bottom surfaces of the accommodating grooves h1 and h2 to the other side of the mold portion 100 may be increased or decreased in one direction. For example, referring to FIGS. 4 and 5, the distance X1 from a bottom surface of each of the accommodating grooves h1 and h2 to the other side of the mold portion 100 increases or decreased in a width direction Y. Accordingly, thicknesses in the vicinity of a center portion of the mold portion 100 and in the vicinity of an outer side of the mold portion 100 may be different from each other.

According to an embodiment, a distance X1 from a bottom surface of the accommodating grooves h1 and h2 to the other side of the mold portion 100 may be maximal in a center portion in a width direction Y of the accommodating grooves h1 and h2. Due to the shapes of the accommodating grooves h1 and h2, the mold portion 100 may have a convex shape based on a center portion in a width direction Y, but is not limited thereto. A distance X1 from a bottom surface of the accommodating grooves h1 and h2 to the other side of the mold portion 100 may be decreased outwardly of the accommodating grooves h1 and h2 in the width direction Y from a center portion of the accommodating grooves h1 and h2 in the width direction Y. According to miniaturization of an electronic component, magnetic flux around a core may be particularly concentrated in the mold portion 100 and the cover portion 200. According to an embodiment, as a shape of the mold portion 100 itself is deformed, as will be described later, the volume and the area, occupied by the external electrodes 400 and 500 in a component, are reduced, so a ratio of a magnetic material to a size of the same component may be increased. Moreover, an external electrode may be formed to be relatively thin, which is advantageous for reducing a thickness of a component.

As an example, the through-grooves H1 and H2 may be formed by a mold when the mold portion 100 is formed, and the accommodating grooves h1 and h2 are formed in the mold portion 100 in a process for forming the cover portion 20 by stacking and pressing a magnetic sheet, including a magnetic material. A protruding portion, corresponding to the through-grooves H1 and H2, is formed in a mold for formation of the mold portion 100, and thus the through-grooves H1 and H2 may be formed in the mold portion 100, manufactured to have a form corresponding to a shape of the mold. Moreover, the accommodating grooves h1 and h2 are not formed in a process for forming of the mold portion 100, but may be formed in a process for forming the cover portion 200 on the mold portion 100. That is, through the through-grooves H1 and H2 of the mold portion 100, both ends of the winding coil 300, protruding from one side of the mold portion 100, may be embedded inwardly of the mold portion 100 in a process for pressing the magnetic sheet. Accordingly, the accommodating grooves h1 and h2 may be formed in one side of the mold portion 100. Alternatively, the accommodating grooves h1 and h2 as well as the through-grooves H1 and H2 may be formed in a process for forming the mold portion 100 using a mold. In this case, in a mold used for formation of the mold portion 100, protruding portions, corresponding to the accommodating grooves h1 and h2 as well as the through-grooves H1 and H2, may be formed.

Referring to FIG. 3, both ends of the winding coil 300 may pass through one side of the mold portion 100 to be disposed in the first and second accommodating grooves h1 and h2, respectively. In an embodiment, widths of the accommodating grooves h1 and h2 are illustrated as being greater than widths of the through-grooves H1 and H2. However, a form, in which ends of the winding coil 300 are disposed in the accommodating grooves h1 and h2, is not limited. Thus, the widths of the accommodating grooves h1 and h2 may be equal to the widths of the through-grooves H1 and H2.

Both ends of the winding coil 300 are exposed to one side of the mold portion 100, that is, the sixth surface 106 of the body B. Both ends of the winding coil 300, exposed to one side of the mold portion 100, are disposed in the accommodating grooves h1 and h2 formed in the sixth surface 106 of the body B to be spaced apart from each other.

Referring to FIGS. 2 and 3, both ends of the winding coil 300 pass through the support portion 110 of the mold portion 100 to be exposed to one side of the support portion 110. In detail, although not illustrated, both ends of the winding coil 300 are equal to a thickness of the winding coil 300, and thus have a form protruding from one side of the support portion 110 by the thickness of the winding coil 300. However, in a process for polishing an opening of a plating resist for formation of the external electrodes 400 and 500, to be described later, the protruding end may be polished together. In this case, ends of the winding coil 300, exposed to one side of the support portion 110, may be substantially smaller than a thickness of the winding coil 300.

The external electrodes 400 and 500 may be spaced apart from each other in one side of the body B, that is, the sixth surface 106. In detail, the external electrodes may be spaced apart from each other on one side of the mold portion 100, and may be connected to both ends of the winding coil 300, respectively.

On a surface of each of the first and second external electrodes 400 and 500, a concave portion may be disposed in a region corresponding to a center portion of each of the accommodating grooves h1 and h2. That is, both ends of the winding coil 300 are disposed along bottom surfaces of the accommodating grooves h1 and h2, and the external electrodes 400 and 500 are applied along both ends of the winding coil 300. Thus, the external electrodes may be formed to correspond to forms of the accommodating grooves h1 and h2. In this regard, when a distance X1 from a bottom surface of the accommodating grooves h1 and h2 to the other side of the mold portion 100 is maximal in a center portion of the accommodating grooves h1 and h2, or decreases outwardly of the accommodating grooves h1 and h2 from a center portion of the accommodating grooves h1 and h2, the external electrodes 400 and 500 may be disposed concavely in a region corresponding to the center portion of the accommodating grooves h1 and h2. As an example, when a conductive resin, including conductive powder such as silver (Ag) is applied to the accommodating grooves h1 and h2 to form the external electrodes 400 and 500, due to the above-described shape of the accommodating grooves h1 and h2, the thus formed shape of an exposed surface of both ends of the winding coil 300, and surface tension of a conductive resin, the concave portion, described above, may be formed in the external electrodes 400 and 500. Compared with a winding type coil component according to the related art, in which an exposed surface of a winding coil 300 is flat, in an embodiment, concave portions are formed in the external electrodes 400 and 500, so an area and a volume of the external electrodes 400 and 500 may be reduced.

The external electrodes 400 and 500 may include a conductive material such as copper (Cu), aluminum (Al), silver (Ag), tin (Sn), gold (Au), nickel (Ni), lead (Pb), chromium (Cr), titanium (Ti), or alloys thereof, but are not limited thereto, The external electrodes 400 and 500 may be formed as a single layer or a plurality of layers. According to an embodiment, the external electrodes 400 and 500 may include a first layer, in contact with and connected to both ends of the winding coil 300, and a second layer covering the first layer. As an example, the first layer may be formed of a conductive resin including silver (Ag) powder, but is not limited thereto. Alternatively, the first layer may be formed by a line plating layer including copper (Cu). In detail, although not illustrated, the second layer may be disposed on the first layer to cover the first layer. The second layer may include nickel (Ni) or tin (Sn). The second layer may be formed by electrolytic plating, but is not limited thereto.

Meanwhile, the coil component 1000 according to an embodiment may further include an insulating layer 130 surrounding a surface of the winding coil 300. A method for forming the insulating layer 130 is not limited. For example, the insulating layer may be formed by chemically vapor-depositing a parylene resin or the like on a surface of the winding coil 300, or may be formed using a known method such as a screen printing, exposure of photo resist (PR), a process through development, spray application, a dipping process, or the like.

The insulating layer 130 is not particularly limited as long as it could be formed as a thin film. For example, the insulating layer may be formed using photo resist (PR), an epoxy resin, or the like.

Meanwhile, although not illustrated, the coil component 1000 according to an embodiment may further include an additional insulating layer in a region of the sixth surface 106 of the body B, except for a region in which the external electrodes 400 and 500 are disposed. The additional insulating layer may be used as a plating resist in forming the external electrodes 400 and 500 by electrolytic plating, but is not limited thereto. In addition, the additional insulating layer is disposed in at least a portion of the first to fifth surfaces 101, 102, 103, 104, and 105 of the body B, and may prevent electrical shorts between other electronic components and the external electrodes 400 and 500.

Meanwhile, in FIGS. 1 to 5, it is illustrated in that the through-grooves H1 and H2 pass through the mold portion 100 inside the mold portion 100, but this is merely exemplary. In other words, as a modification of an embodiment, the through-grooves H1 and H2 are formed in side surfaces of the mold portion 100 and may be connected to the accommodating grooves h1 and h2, disposed on one side of the mold portion 100. In this case, both ends of the winding coil 300 may be disposed along a side surface of the mold portion 100 and one side of the mold portion 100.

Second Embodiment

Figure 6:
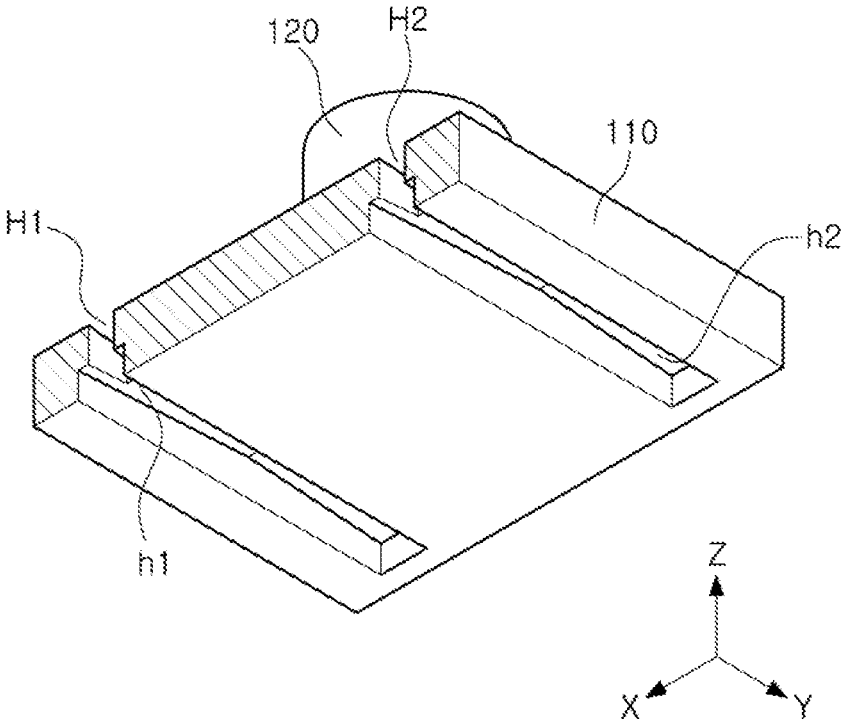
FIG. 6 is a perspective view in which a portion of a mold portion, applied to the coil component according to a second embodiment, is cut on the X-Z plane and seen from a lower direction.
Figure 7:
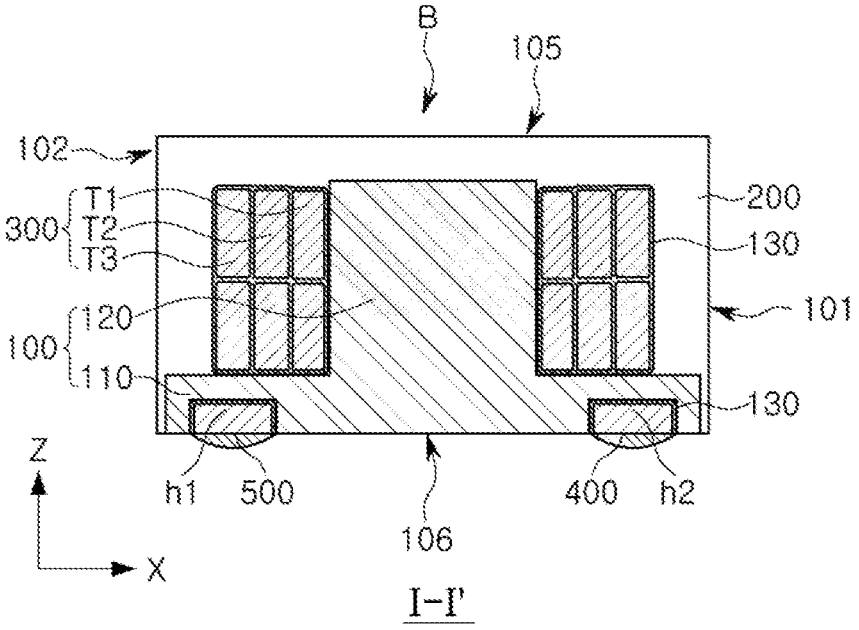
FIG. 7 is a view in which a mold portion, applied to the coil component according to a second embodiment, is taken on line I-I' of FIG. 1.
Figure 8:
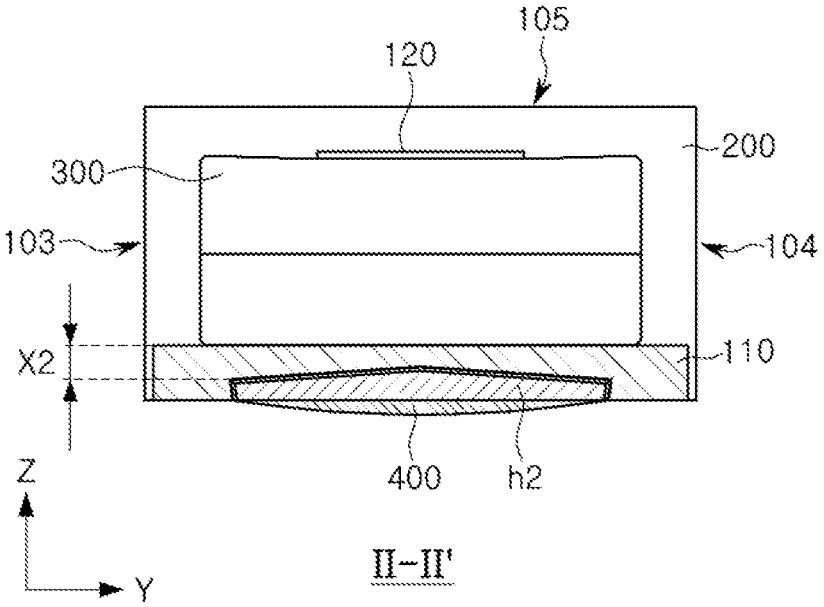
FIG. 8 is a view in which a mold portion, applied to the coil component according to a second embodiment, is taken on line II-II' of FIG. 1.

FIG. 6 is a perspective view in which a portion of a mold portion, applied to the coil component according to a second embodiment, is cut on the X-Z plane and seen from a lower direction. FIG. 7 is a view in which a mold portion, applied to the coil component according to a second embodiment, is taken on line I-I' of FIG. 1. FIG. 8 is a view in which a mold portion, applied to the coil component according to a second embodiment, is taken on line II-II' of FIG. 1.

Referring to FIGS. 6 to 8, compared with the coil component 1000 according to a first embodiment, a coil component according to a second embodiment includes accommodating grooves h1 and h2 as well as external electrodes 400 and 500 with different shapes. Thus, in the description of an embodiment, only the accommodating grooves h1 and h2 as well as the external electrodes 400 and 500 will be described, which are different from those in a first embodiment. The description of a first embodiment may be applied to other configurations of an embodiment as it is.

Referring to FIGS. 6 to 8, the accommodating grooves h1 and h2, applied to an embodiment, may be formed to allow a distance X2 from a bottom surface of the accommodating grooves h1 and h2 to the other side of the mold portion 100 to be minimal in a center portion in a width direction Y. The distance X2 from a bottom surface of the accommodating grooves h1 and h2 to the other side of the mold portion 100 may be increased outwardly of the accommodating grooves h1 and h2 in the width direction Y from a center portion in the width direction Y. Due to the shapes of the accommodating grooves h1 and h2, the mold portion 100 may have a concave shape based on a center portion in a width direction Y, but is not limited thereto. According to miniaturization of an electronic component, magnetic flux around a core 120 may be particularly concentrated in the mold portion 100 and the cover portion 200. According to a second embodiment, as a shape of the mold portion 100 itself is deformed, the volume and the area, occupied by the external electrodes 400 and 500 in a component, are reduced, so a ratio of a magnetic material to a size of the same component may be increased.

Moreover, an external electrode may be formed to be relatively thin, which is advantageous for reducing a thickness of a component.

In a second embodiment, ends of the winding coil 300 are disposed along bottom surfaces of the accommodating grooves h1 and h2, and the external electrodes 400 and 500 are applied along the ends of the winding coil 300. Thus, the external electrodes 400 and 500 may be formed to correspond to forms of the accommodating grooves h1 and h2. Referring to FIGS. 7 and 8, the external electrodes 400 and 500 are disposed in the accommodating grooves h1 and h2, processed to be concave inwardly of the mold portion 100, thereby reducing areas of the external electrodes 400 and 500, protruding outwardly of the body B. Compared with a winding type coil component according to the related art, in which an exposed surface of a winding coil 300 is flat, the external electrodes 400 and 500 are disposed inwardly of the mold portion 100, so an area and a volume of the external electrodes 400 and 500 may be reduced in the entirety of a coil component.

Third Embodiment

Figure 9:
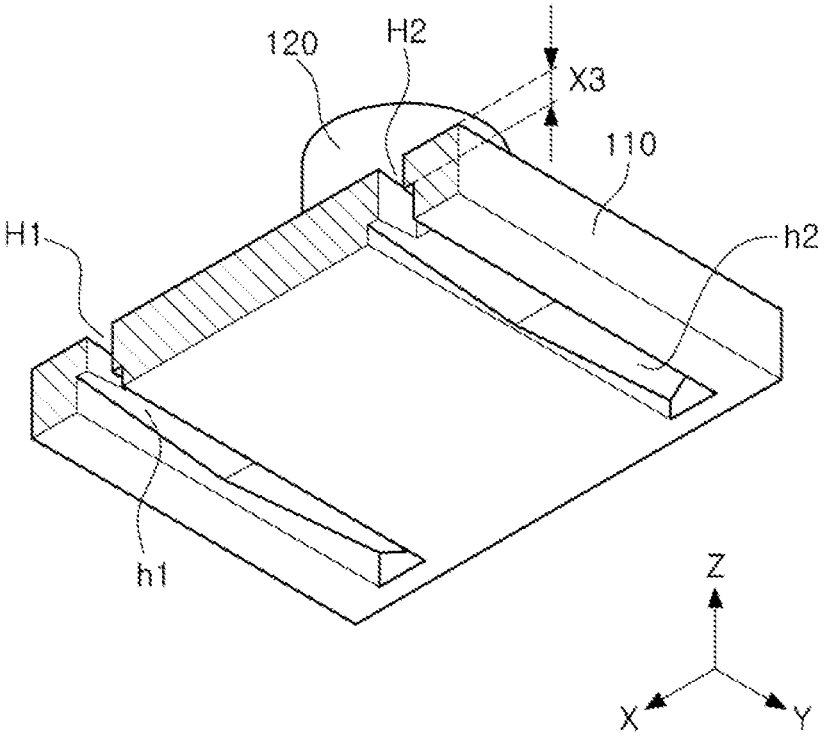
FIG. 9 is a perspective view in which a portion of a mold portion, applied to the coil component according to a third embodiment, is cut on the X-Z plane and seen from a lower direction.

FIG. 9 is a perspective view in which a portion of a mold portion, applied to the coil component according to a third embodiment, is cut on the X-Z plane and seen from a lower direction.

Referring to FIG. 9, compared with the coil component according to first and second embodiments, in a coil component according to a third embodiment, a distance X3 from bottom surfaces of accommodating grooves h1 and h2 to the other side of the mold portion 100 increases or decreased in a different direction. Thus, in the description of an embodiment, a direction, in which the distance X3 from bottom surfaces of accommodating grooves h1 and h2 to the other side of the mold portion 100 increases or decreased, will be only described, which is different from those in first and second embodiments. The description of first and second embodiments may be applied to other configurations of an embodiment as it is.

In a third embodiment, the distance X3 from a bottom surface of the accommodating grooves h1 and h2 to the other side of the mold portion 100 increases or decreased in the other direction, perpendicular to one direction. That is, for example, the distance X3 from bottom surfaces of the accommodating grooves h1 and h2 to the other side of the mold portion 100 may be increased or decreased in a longitudinal direction X, perpendicular to a width direction Y. Accordingly, in the longitudinal direction X, thicknesses in the vicinity of a center portion of the mold portion 100 and in the vicinity of an outer side of the mold portion 100 may be different from each other.

As an example, the distance X3 from bottom surfaces of the accommodating grooves h1 and h2 to the other side of the mold portion 100 may be maximal in a region adjacent to a center portion of the mold portion 100 in a longitudinal direction X. The distance X3 from bottom surfaces of the accommodating grooves h1 and h2 to the other side of the mold portion 100 may be reduced from an interior of the accommodating grooves h1 and h2 in the longitudinal direction X to an exterior of the accommodating grooves h1 and h2 in the longitudinal direction X. According to miniaturization of an electronic component, magnetic flux around a core may be particularly concentrated in the mold portion 100 and the cover portion 200. According to a third embodiment, as a shape of the mold portion 100 itself is deformed, the volume and the area, occupied by the external electrodes 400 and 500 in a component, are reduced, so a ratio of a magnetic material to a size of the same component may be increased.

Moreover, an external electrode may be formed to be relatively thin, which is advantageous for reducing a thickness of a component.

As set forth above, according to an embodiment in the present disclosure, a coil component may be lightweight, thin, short, and small, and may maintain component characteristics by securing a magnetic flux area.

While exemplary embodiments have been shown and described above, it will be apparent to those skilled in the art that modifications and variations could be made without departing from the scope of the present invention as defined by the appended claims.

What is claimed is:

1. A coil component, comprising: a mold portion having a first surface and a second surface opposing each other in a thickness direction;

a winding coil disposed on the second surface of the mold portion;

a cover portion disposed on the mold portion and the winding coil; and accommodating grooves disposed on the first surface of the mold portion and spaced apart from each other in a longitudinal direction of the coil component perpendicular to the thickness direction, both ends of the winding coil being disposed in the accommodating grooves, respectively, wherein an accommodating groove of the accommodating grooves extends from one side of the mold portion in a width direction perpendicular to the thickness and longitudinal directions, and the accommodating groove includes inclined surfaces, angled with respect to the width direction, extending from one end to the other end of the accommodating groove, such that a minimum distance from the accommodating groove to the second surface of the mold portion, in the thickness direction of the molded portion and the winding coil, increases in the width direction.

2. The coil component of claim 1, wherein the minimum distance from the accommodating groove to the second surface of the mold portion decreases from a center portion of the accommodating grooves outwardly of the accommodating groove.

3. The coil component of claim 1, wherein the minimum distance from the accommodating groove to the second surface of the mold portion is minimal in a center portion of the accommodating groove.

4. The coil component of claim 1, wherein the minimum distance from the accommodating groove to the second surface of the mold portion increases from a center portion of the accommodating groove outwardly of the accommodating groove.

5. The coil component of claim 1, wherein the minimum distance from the accommodating groove to the second surface of the mold portion increases or decreases in the longitudinal direction perpendicular to the width direction.

6. The coil component of claim 1, wherein the molded portion includes a core around which the winding coil is wound, the winding coil has an innermost turn adjacent to the core, at least one middle turn, and an outermost turn, and a width and a thickness of the innermost turn are equal to a width and a thickness of the outermost turn, respectively.

7. The coil component of claim 1, wherein each of both ends of the winding coil pass through the mold portion.

8. The coil component of claim 1, wherein the winding coil includes at least two stacks of coil turns in a thickness direction of the molded portion in parallel to a direction connecting the first and second surfaces of the molded portion.

9. The coil component of claim 1, wherein each of the first and second accommodation grooves is exposed to one side surface of the molded portion.

10. The coil component of claim 1, further comprising:

first and second external electrodes disposed in the accommodating grooves to be respectively connected to the both ends of the winding coil, wherein the first or second external electrode has a convex shape, and a thickness of the first or second external electrode, immediately below a portion of the accommodating groove having a largest thickness in the thickness direction, is greater than a thickness of the first or second external electrode, immediately below a portion of the accommodating groove having a smallest thickness in the thickness direction.

11. The coil component of claim 1, wherein the both end portions of the winding coil bend toward the first surface in a direction connecting the first and second surfaces of the molded portion, and penetrating through the accommodating grooves, respectively.

12. The coil component of claim 11, wherein the both end portions of the winding coil further bend toward one side surface of the molded portion in the width direction, and extend onto the accommodating grooves in the width direction.

13. The coil component of claim 1, wherein the minimum distance from the accommodating groove to the second surface of the mold portion is maximal in a center portion of the accommodating groove.

14. The coil component of claim 13, further comprising:

first and second external electrodes disposed in the accommodating grooves to be respectively connected to the both ends of the winding coil, wherein a concave portion is disposed in a region corresponding to the center portion of the accommodating groove, in each of the first and second external electrodes.

15. The coil component of claim 14, further comprising an insulating layer surrounding a surface of the winding coil, wherein the insulating layer is disposed on the surface of the winding coil, except for regions in which the first and second external electrodes are disposed.

16. The coil component of claim 14, wherein each of the first and second external electrodes includes a first layer in contact with and connected to the both ends of the winding coil, and a second layer covering the first layer.

17. The coil component of claim 16, wherein the first layer includes silver (Ag), and the second layer includes nickel (Ni) or tin (Sn).

18. The coil component of claim 16, wherein the first layer includes a conductive resin layer.

* * * * *